United States Patent [19]

Lillard

[11] Patent Number: 4,576,141

[45] Date of Patent: Mar. 18, 1986

[54] FIREPLACE APPARATUS FOR SLIDING DOOR APERTURE

[76] Inventor: Robert M. Lillard, 3708 Watseka Ave., #316, Los Angeles, Calif. 90034

[21] Appl. No.: 692,215

[22] Filed: Jan. 17, 1985

[51] Int. Cl.[4] ..... F24B 1/18

[52] U.S. Cl. ..... 126/120; 126/123; 126/138; 126/126; 52/37; 52/208

[58] Field of Search ..... 126/120, 121, 123, 125, 126/126, 140, 138, 202, 4; 237/51; 52/37, 208, 218

[56] References Cited

U.S. PATENT DOCUMENTS

| | | | |
|---|---|---|---|
| 803,938 | 11/1905 | Thompson | 126/138 |
| 3,970,067 | 7/1976 | Vaughn | 126/120 |
| 4,026,264 | 5/1977 | Henriques | 126/123 |
| 4,138,985 | 2/1979 | Marley | 126/66 |
| 4,194,688 | 3/1980 | Cobos | 126/121 |
| 4,254,596 | 3/1981 | Wright et al. | 126/120 |
| 4,256,083 | 3/1981 | Wilson | 126/121 |
| 4,259,941 | 4/1981 | Gerdes | 126/120 |
| 4,351,315 | 9/1982 | Babbage | 126/125 X |

*Primary Examiner*—Margaret A. Focarino
*Attorney, Agent, or Firm*—Allan M. Shapiro

[57] ABSTRACT

Fireplace apparatus includes panel which is removably inserted in the opening of a sliding door. The panel carries fireplace decor on its interior surface and includes an openable glass or screen windowed fireplace door. A firebox having a front opening is secured to the panel behind the fireplace door so that a fire in the firebox can be viewed through the fireplace door. The firebox preferably has a door to close its front opening and a door to permit access into the top of the firebox so that the firebox can be equipped for and used for grilling away from the panel.

5 Claims, 6 Drawing Figures

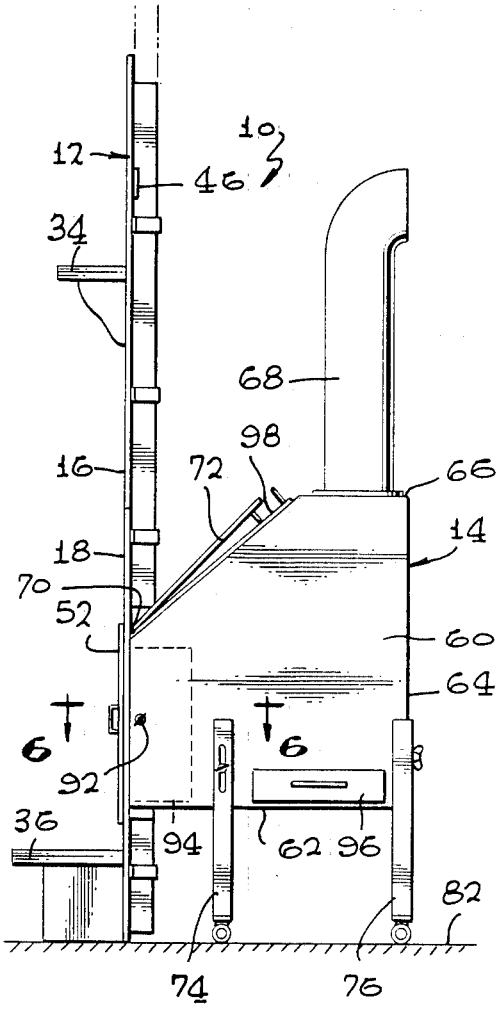
FIG. 3
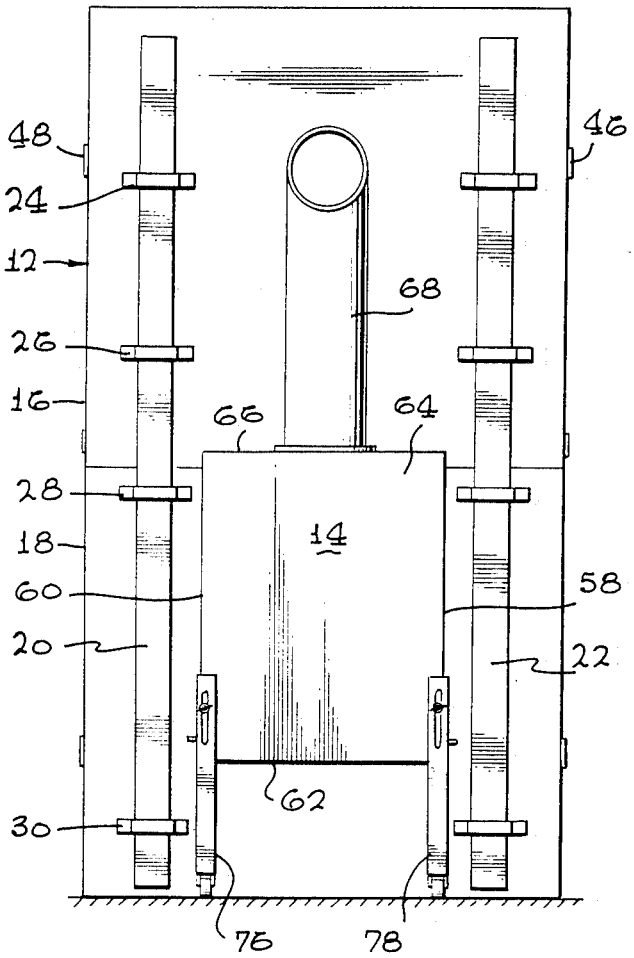
FIG. 4
FIG. 5
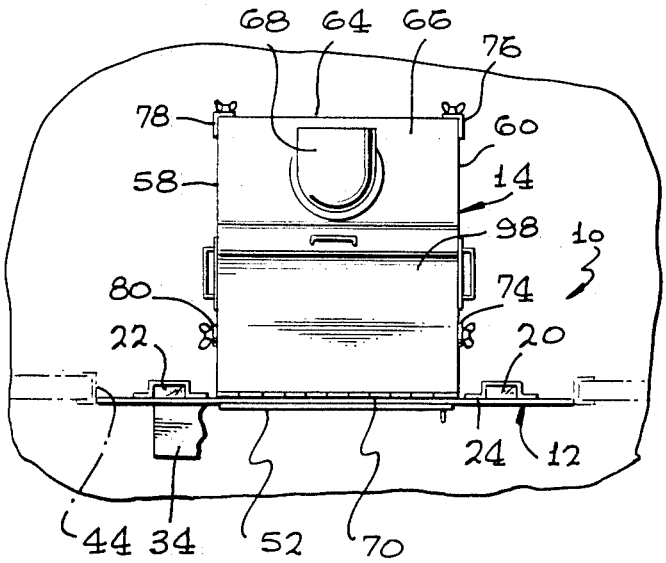
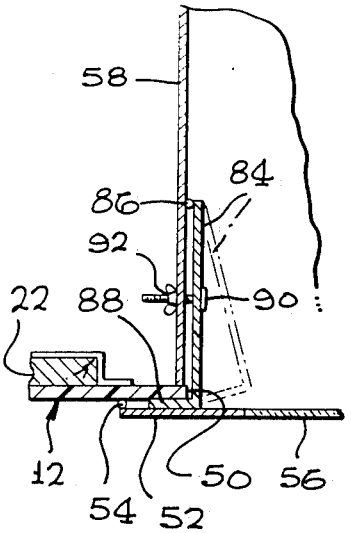
FIG. 6

FIREPLACE APPARATUS FOR SLIDING DOOR APERTURE

BACKGROUND OF THE INVENTION

This invention is directed to a fireplace apparatus which permits the temporary installation of a fireplace in rooms having a sliding door in an opening to a balcony or patio. A panel is placed in the opening, and a firebox is secured behind the panel, with the fireplace door in the panel permitting access to the interior of the firebox and viewing of a fire therein.

The modern trend is towards population concentration in cities. Housing units are in the form of townhouses or multi-story structures. Such housing units do not readily lend themselves to the inclusion of a built-in fireplace. Where fireplaces are included, a considerable amount of cost is involved in the fireplace and its dedicated chimney.

Residents of such housing units, from time to time, desire the effect and pleasure of viewing a fire in a fireplace. Therefore, there is need for a fireplace apparatus which can be temporarily installed in the sliding door aperture leading to a balcony or patio of such a housing unit to provide the pleasures of a fireplace.

SUMMARY OF THE INVENTION

In order to aid in the understanding of this invention, it can be stated in essentially summary form that it is directed to a fireplace apparatus for a sliding door aperture or the like which includes a panel for removable placement in the aperture, with the panel including a fireplace opening therein. The apparatus also includes a portable firebox for positioning behind the fireplace opening so that a removable fireplace apparatus is achieved.

It is, thus, an object and advantage of this invention to provide a fireplace apparatus including a panel which can be removably positioned within a sliding door aperture or a similar aperture in the wall of a residental unit, with the panel carrying thereon decor so that it resembles a fireplace wall. The panel has a fireplace opening therein through which a fire can be viewed.

It is another object and advantage of this invention to provide a fireplace apparatus which includes a portable firebox having an opening on the front thereof so that the firebox can be placed behind such a fireplace panel for viewing a fire in the firebox through the fireplace opening in the panel.

It is a further object and advantage of this invention to provide a fireplace apparatus which can readily be installed to provide a live fireplace of good appearance, and which can be quickly and readily removed for storage.

It is a further object and advantage of this invention to provide a firebox which can be used in association with a panel, and also can be used separately from the panel as a grill for the grilling of food so that the firebox has additional utility.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 3 is an edge-elevational view of the panel, together with a side-elevational view of the firebox in position.

FIG. 4 is a rear-elevational view thereof.

FIG. 5 is a top plan view thereof.

FIG. 6 is an enlarged section taken generally along the line 6—6 of FIG. 3, with parts broken away.

DESCRIPTION OF THE PREFERRED EMBODIMENT

Figure 1:
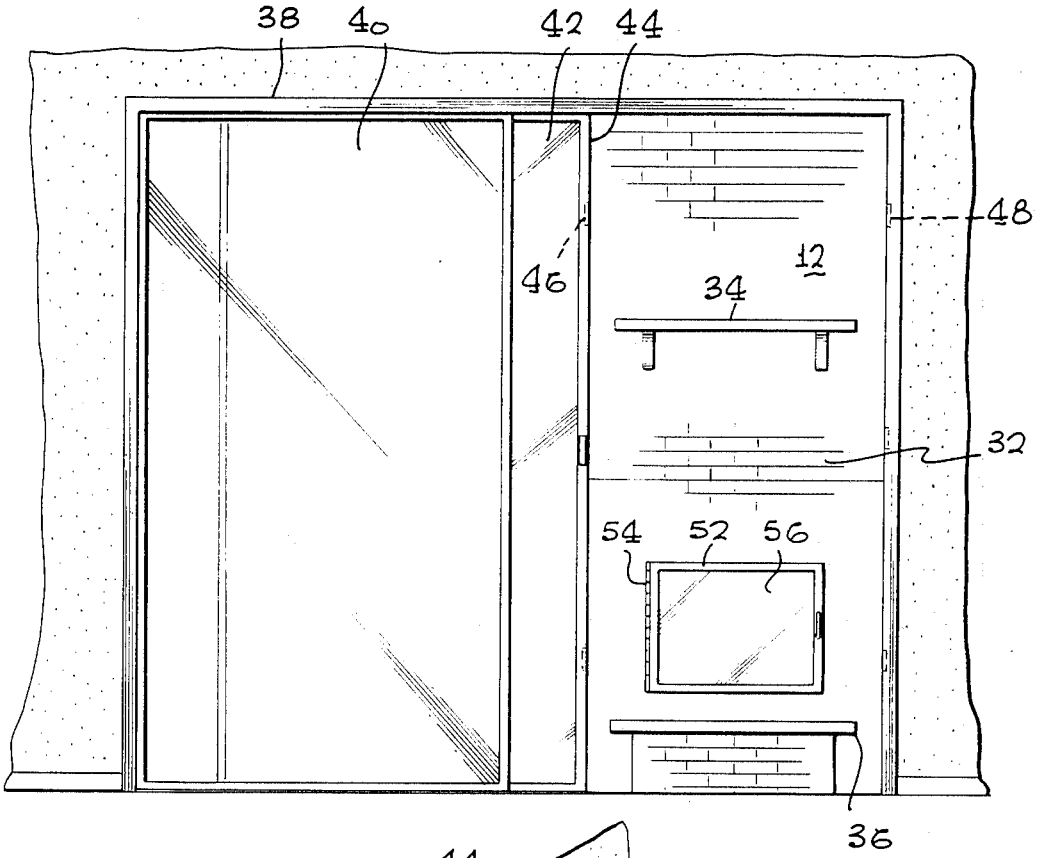
FIG. 1 is an elevational view from the interior of a housing unit showing the fireplace apparatus of this invention installed in the sliding door aperture of the housing unit.

The fireplace apparatus 10 of this invention is a combination of panel 12 and firebox 14. As is seen in FIGS. 3 and 4, panel 12 is made up of upper and lower sections 16 and 18 which lie together in the same plane when they are assembled. Bars 20 and 22 extend up across the back of both sections to firmly hold them in the same plane. Bar 20 extends through straps 24 and 26 which are secured on the back of upper panel 20 and extends through straps 28 and 30 which are secured on the back of the lower panel 18. Bar 22 extends through straps of the same character. In this way, sections can be separated by removal of the bars for easy storage and can be firmly held with respect to each other by installation of the bars, as shown.

Figure 2:
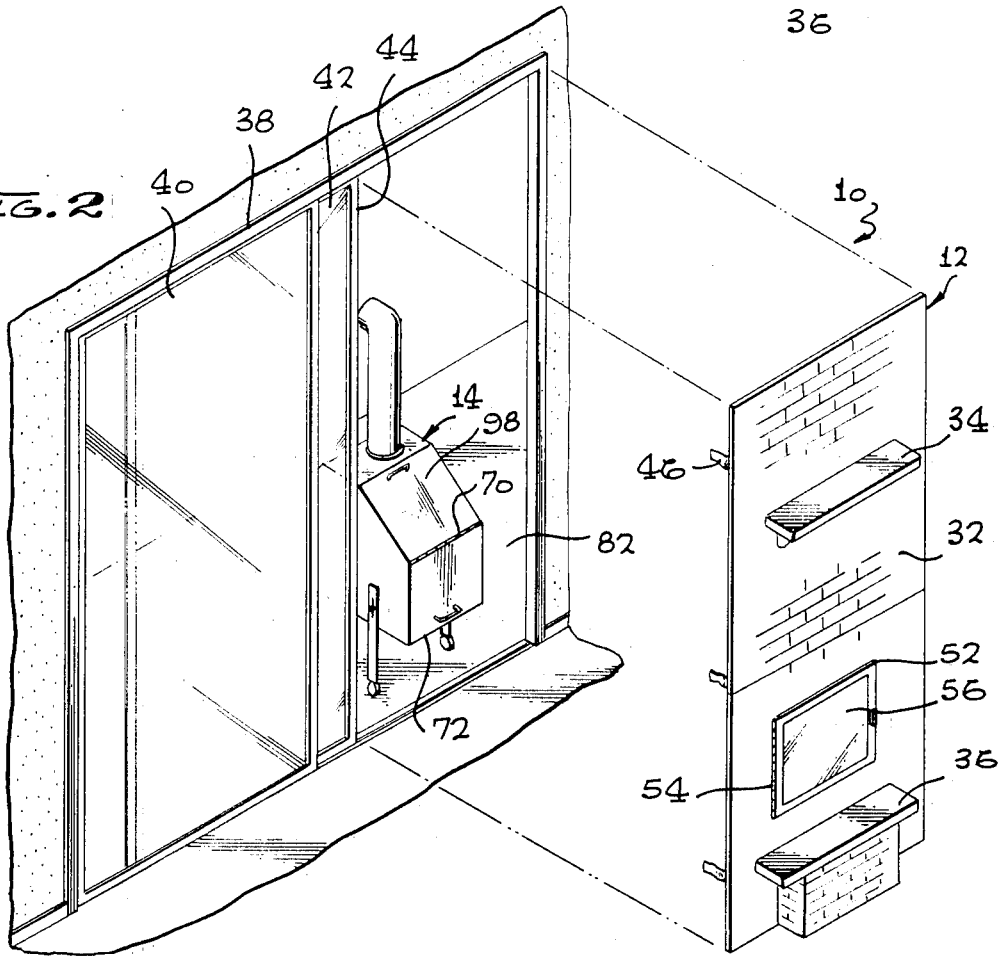
FIG. 2 is an exploded isometric view thereof on reduced scale, showing the panel projected forward to show the firebox in position with respect to the sliding door aperture.

The front of panel 12 carries on its surface 32 suitable decoration such as the bricklike surface texture and color shown in FIGS. 1 and 2. In addition, mantle shelf 34 and hearth 36 are detachably secured to the front of the panel. Attachment and detachment can be accomplished by bolts or screws extending through the panel and respectively into the mantle shelf and hearth. The mantle shelf and hearth can be removed so that, during storage, the upper and lower panel sections can lie flat. The panel sections can be made of plywood and are sized so that when the two sections are assembled into the panel, the panel fits in the open aperture presented when a sliding door is in the open position.

FIGS. 1 and 2 illustrate a sliding doorframe 38 in the outside wall of a housing unit, between the interior and the exterior thereof. Such doorframes often carry a fixed door panel 40. They are provided with a sliding door panel 42 which can be slid from a closed position to an open position where it overlaps door 40. In the open position, it presents the aperture 44 in which the panel 12 is positioned. Panel 12 may be more narrow than the full width of the aperture 44, as indicated in FIG. 1, so that there is a narrow space through which the user can pass in and out in setting up the fireplace apparatus. On the other hand, the panel may occupy the full door aperture if desired, and if there is other access.

If desired, ears such as ears 46 and 48 can be provided on the edges of the panel to interact with the edges of the aperture to help retain panel 12 in position. Comparable ears at the lower portion of the panel are also indicated in FIGS. 1 and 4.

Panel 12 also carries therein an opening 50, see FIG. 6, which is the fireplace opening. It is through this opening that the fire is viewed. Fireplace door 52 is carried on hinge 54, see FIGS. 1, 2 and 6, and is positioned so that it can be opened and closed over the opening 50. Furthermore, fireplace door 52 is a metal-bound door with a glass window 56 or screen to permit viewing of the firebox through the closed fireplace door. When assembled and installed, the appearance of the panel 12 is that shown in FIG. 1.

Firebox 14 is particularly configured to fit up against the opening in panel 12 so that the fire in the firebox can be seen from the front of the panel. Firebox 14 has left and right walls 58 and 60, bottom wall 62 and back wall 64. In addition, it has top wall 66 of smaller dimension. These walls are secured together to form the major portion of the firebox. There is an opening in top wall 66 upon which is mounted flue 68. The flue is preferably configured so that combustion gases are directed away from the building structure of the housing unit. Hinge 70 is secured to the left and right side walls at the upper front corner thereof. Swingably mounted on hinge 70 is lower door 72 which is shown in its lowered, closed position in FIG. 2 and in its raised, open position in FIG. 3. When it is in its raised position, the front of firebox 14 is open and the opening corresponds to the opening 50 in the panel.

Four legs 74, 76, 78 and 80 support the firebox. Each of the legs has a wheel thereunder to permit ease of movement of the firebox. The wheels may be castered, if desired. In addition, each of the legs is vertically adjustable with respect to the body of the firebox. As is seen in FIGS. 3 and 4, bolts secured in the body of the firebox extend through slots in the legs and thumbscrews clamp the legs to the body of the firebox at the selected height. This adjustment is provided because the patio floor 82 outside of the sliding door may be uneven or may be at other than the preselected design height. With this adjustment of the legs 74 through 80, the body of the firebox can be positioned to exactly match with the opening 50 in the panel.

Clamps retain the firebox in place with respect to the opening. As is seen in FIG. 5, L-shaped clamp 84 has a rib 86 around which the clamp pivots. Flange 88 engages in front of panel 12 to clamp the firebox against the panel. Bolt 90 extends through the clamp and through the left sidewall 58. Wing nut 92 tightens on the bolt and secures clamp 84 in place. Left wall 58 may have a slot through which bolt 90 engages in order to aid in alignment. The materials provided at this juncture between the panel and the firebox are chosen such as to prevent excessive heat transfer to flammable materials. High temperature insulating materials can be placed to provide fire-safe construction. Another similar clamp 94 is provided on the right side wall 60 and is illustrated in dotted lines in FIG. 3. In this way, the firebox can be secured in place against the panel.

The firebox has a suitable grate therein for the burning of wood therein. It is provided with an ash drawer 96, see FIG. 3, to permit removal of the ashes without opening the fireplace door 52. In addition, the firebox is provided with a grill rack extending horizontally thereacross at the level of hinge 70. The fire grate is below the grill rack, and access to the grill rack is provided by grill door 98, which is shown closed in FIGS. 2, 3 and 5. Grill door 98 is mounted on the same hinge 70. With this construction, the firebox can be moved away from the panel, and the lower door 72 can be closed. A fire on the grate will permit grilling on the grill rack. Opening of grill door 98 provides access to the top of the grill rack. Thus, the firebox has utility as a grill, in addition to the utility provided as an ornamental fireplace. Combustibles other than wood can be used in the firebox, such as coal and charcoal, and chemical or manufactured logs such as Duraflame and Prestologs.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A fireplace apparatus comprising in combination:

a panel, said panel being substantially flat and being sized to be removably positioned within a sliding door aperture, said panel having a panel opening therein;

a firebox comprising a substantially closed box having a front opening therein, said firebox being positionable with respect to said panel so that said front opening in said firebox is in substantial alignment with said panel opening so that the interior of said firebox can be viewed through said panel and front openings, said firebox including a lower door for removably positioning over said front opening and including an upper door positioned above said lower door for access to the upper part of the interior of said firebox, said upper door being angularly oriented with respect to the vertical; and means for supporting said firebox so that it is removably positioned with said panel and front openings in substantial alignment.

2. The combination of claim 1 where both said upper door and said lower door on said firebox are hinged on the same hinge.

3. A fireplace apparatus comprising in combination:

a panel, said panel being substantially flat and being sized to be removably positioned within a sliding door aperture, said panel having an opening therein, said panel being made in at least two sections, means attached to each of said sections for detachably securing said sections into a panel, said means comprising at least one strap secured to each of said sections and a bar for detachable engagement with said straps for retaining said sections together to form said panel;

a firebox, said firebox having an opening therein, said firebox being positionable with respect to said panel so that said opening in said firebox is in substantial alignment with said opening in said panel so that the interior of said firebox can be viewed through said opening; and means for supporting said firebox so that it is removably positioned with said openings in substantial alignment.

4. A fireplace apparatus comprising in combination:

a panel, said panel being substantially flat and being sized to be removably positioned within a sliding door aperture, said panel having an opening therein;

a firebox, said firebox having an opening therein, said firebox being positionable with respect to said panel so that said opening in said firebox is in substantial alignment with said opening in said panel so that the interior of said firebox can be viewed through said opening; and support means for supporting said firebox so that it is removably positioned with said openings in substantial alignment, said support means comprising adjustable supports extending from the bottom of said firebox for supporting said firebox on a floor adjacent said panel and further comprising wheels on the lower ends of said adjustable supports for ease in moving said firebox into position adjacent said panel.

5. The combination of claim 4 wherein said supports are legs, and said legs have upright slots therein and tightening means in said slots for adjustment of the length of said legs below the firebox and securing them at the selected position.

* * * * *